US011933536B2

(12) United States Patent
Auyer et al.

(10) Patent No.: US 11,933,536 B2
(45) Date of Patent: Mar. 19, 2024

(54) SYSTEM AND METHOD FOR AUTOMATICALLY CLEANING REFRIGERATION COILS

(71) Applicant: Carrier Corporation, Palm Beach Gardens, FL (US)

(72) Inventors: Douglas Auyer, Palm Beach Gardens, FL (US); Kurt Handley, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 444 days.

(21) Appl. No.: 17/255,926

(22) PCT Filed: Sep. 9, 2020

(86) PCT No.: PCT/US2020/049906
§ 371 (c)(1),
(2) Date: Dec. 23, 2020

(87) PCT Pub. No.: WO2021/050522
PCT Pub. Date: Mar. 18, 2021

(65) Prior Publication Data

US 2023/0134449 A1 May 4, 2023

Related U.S. Application Data

(60) Provisional application No. 62/898,708, filed on Sep. 11, 2019.

(51) Int. Cl.

| | |
|---|---|
| ***F25D 29/00*** | (2006.01) |
| ***F28G 9/00*** | (2006.01) |
| ***F28G 15/00*** | (2006.01) |

(52) U.S. Cl.
CPC ..... *F25D 29/003* (2013.01); *F28G 9/00* (2013.01); *F28G 15/003* (2013.01); *F25D 2323/00283* (2013.01); *F25D 2400/22* (2013.01)

(58) Field of Classification Search
CPC ..... F28G 9/00; F28G 15/003; F28D 15/003; F25D 11/003; F25D 19/003
See application file for complete search history.

(56) References Cited

U.S. PATENT DOCUMENTS 4,109,485 A 8/1978 Grosskopf
4,930,460 A 6/1990 Aihara et al.
(Continued)

FOREIGN PATENT DOCUMENTS

CN 106642400 5/2017
DE 102012009902 A1 * 11/2013 ..... F28G 9/00
(Continued)

OTHER PUBLICATIONS

DE-102012009902-A1 English machine translation (Year: 2012).*
(Continued)

*Primary Examiner* — Jenna M Hopkins
(74) *Attorney, Agent, or Firm* — Carlson, Gaskey & Olds, P.C.

(57) ABSTRACT

A transportation container includes a storage volume. A refrigeration system is contained within the storage volume. The refrigeration system includes a fan configured to ingest exterior air, a condenser coil immediately downstream of the fan, and a vent configured exhaust spent cooling air from the storage volume. A controller is configured to control the refrigeration system. the controller includes instructions configured to cause the refrigeration system to detect an indication of operational deterioration of a transportation container refrigeration system, reverse a rotational direction
(Continued)

of an airflow fan such that air is drawn over a refrigeration coil and expelled from the transportation container using the airflow fan, and revert the rotational direction of the airflow fan at a conclusion of a cleaning operation.

25 Claims, 2 Drawing Sheets

(56) References Cited

U.S. PATENT DOCUMENTS

| | | | | |
|---|---|---|---|---|
| 5,003,786 | A * | 4/1991 | Fudono | F25D 21/002 62/155 |
| 5,226,285 | A | 7/1993 | Dankowski | |
| 6,158,794 | A * | 12/2000 | Flanagan | B60H 1/00514 296/24.35 |
| 6,931,884 | B2 * | 8/2005 | Kolda | F25D 19/003 62/239 |
| 2002/0124586 | A1 * | 9/2002 | Trulaske, Sr. | F25B 47/00 62/303 |
| 2006/0080982 | A1 * | 4/2006 | Reichle | F28G 13/00 62/181 |
| 2019/0298084 | A1 * | 10/2019 | Billings | G05B 19/042 |

FOREIGN PATENT DOCUMENTS

| | | | | |
|---|---|---|---|---|
| GB | 2249827 | A * | 5/1992 | F28G 9/00 |
| JP | 2000043552 | | 2/2000 | |
| JP | 2000123238 | | 4/2000 | |
| JP | 2003196723 | | 7/2003 | |
| JP | 4016368 | | 12/2007 | |
| JP | 2010014313 | | 1/2010 | |
| JP | 5681577 | | 3/2015 | |
| WO | 2016179150 | | 11/2016 | |

OTHER PUBLICATIONS

International Search Report and Written Opinion for International Patent Application No. PCT/US2020/049906 dated Nov. 26, 2020.
International Preliminary Report on Patentability for International Patent Application No. PCT/US2020/049906 dated Mar. 15, 2022.

* cited by examiner

SYSTEM AND METHOD FOR AUTOMATICALLY CLEANING REFRIGERATION COILS

CROSS-REFERENCE TO RELATED APPLICATION

This application claims priority to U.S. Provisional Application No. 62/898,708 filed on Sep. 11, 2019.

TECHNICAL FIELD

The present disclosure relates generally to refrigeration systems for transportation containers, and more specifically to a system and method for automatically cleaning condenser coils in a refrigerated transportation container.

BACKGROUND

Transportation containers, such as those used in trans-oceanic shipping and similar shipping environments are typically designed with relatively uniform exterior dimensions for ease of shipping. In some cases the shipping means, such as cargo ship, can take long periods of time to transport the container. Some goods that are shipped in the containers are required to be maintained within a temperature controlled environment in order to prevent damage or spoilage. In such cases refrigeration systems are included in the interior of the transportation container. Due to the configuration of the refrigeration systems, they can be difficult to access during the shipping process, and maintenance is typically performed after unloading and before re-loading the transportation container.

Certain shipping environments, such as cargo vessels, can expose the transportation container to substantial amounts of contaminants and debris. This debris can be ingested by the refrigeration system and can cause a decrease in performance of the refrigeration system. Due to the access difficulties, as well as the practical realities of shipping systems, existing refrigerated transportation containers can be difficult to repair or clean during transportation.

SUMMARY OF THE INVENTION

In one example, a method for cleaning a refrigeration coil of a refrigerated transportation container includes detecting an indication of operational deterioration of a transportation container refrigeration system using a controller, reversing a rotational direction of an airflow fan from a first direction to a second direction such that air is drawn over a refrigeration coil and expelled from the transportation container using the airflow fan, and reverting the rotational direction of the airflow fan to the first direction at a conclusion of a cleaning operation.

In another example of the above method, the indication of operational deterioration is a refrigeration system pressure drop detected by a sensor.

In another example of any of the above methods, the indication of operational deterioration is an increase in a steady temperature of the transportation container detected by a sensor.

In another example of any of the above methods, the indication of operational deterioration is a manually applied trigger.

In another example of any of the above methods, reversing the rotational direction of the airflow fan further comprising increasing a speed of the airflow fan, thereby creating a burst of airflow.

In another example of any of the above methods, increasing the speed comprising maintaining the increased speed until the step of reverting the rotational direction of the airflow fan.

In another example of any of the above methods, increasing the speed comprises iteratively increasing and decreasing the speed of the fan, thereby pulsing an airflow through the airflow fan.

In another example of any of the above methods, the conclusion of the cleaning operation is defined by a predetermined duration.

In another example of any of the above methods, wherein reversing the rotational direction of an airflow fan further comprises activating a spray nozzle, and spraying a liquid onto the refrigeration coil.

In another example of any of the above methods, the indication of operational deterioration is a self-cleaning operation required signal from a telematics device.

In one example, a transportation container includes a storage volume, a refrigeration system contained within the storage volume, the refrigeration system including a fan configured to ingest exterior air, a condenser coil immediately downstream of the fan, and a vent configured exhaust spent cooling air from the storage volume, a controller configured to control the refrigeration system, the controller including instructions configured to cause the refrigeration system to detect an indication of operational deterioration of a transportation container refrigeration system, reverse a rotational direction of an airflow fan from a first direction to a second direction such that air is drawn over a refrigeration coil and expelled from the transportation container using the airflow fan, and revert the rotational direction of the airflow fan to the first direction at a conclusion of a cleaning operation.

In another example, the above transportation container includes at least one fluid spray nozzle disposed downstream of the condenser coil, relative to a direction of airflow during cooling operations.

In another example of any of the above transportation containers, the spray nozzle is connected to at least one of a water source and a cleaner source.

In another example, any above transportation container includes at least one of a condenser coil pressure sensor disposed at the condenser coil and a container temperature sensor.

In another example of any of the above transportation containers, reversing the rotational direction of the airflow fan further includes increasing a speed of the airflow fan, thereby creating a burst of airflow.

In another example of any of the above transportation containers, increasing the speed includes maintaining the increased speed until the step of reverting the rotational direction of the airflow fan.

In another example of any of the above transportation containers, increasing the speed includes iteratively increasing and decreasing the speed of the fan, thereby pulsing an airflow through the airflow fan.

In another example of any of the above transportation containers, the controller is configured to be connected to at least one self-cleaning operation manual activation system.

In another example of any of the above transportation containers, the controller is directly connected to the manual activation system.

In another example of any of the above transportation containers, the controller is connected to the manual activation system through at least one intermediary controller.

These and other features of the present invention can be best understood from the following specification and drawings, the following of which is a brief description.

DETAILED DESCRIPTION

Figure 1:
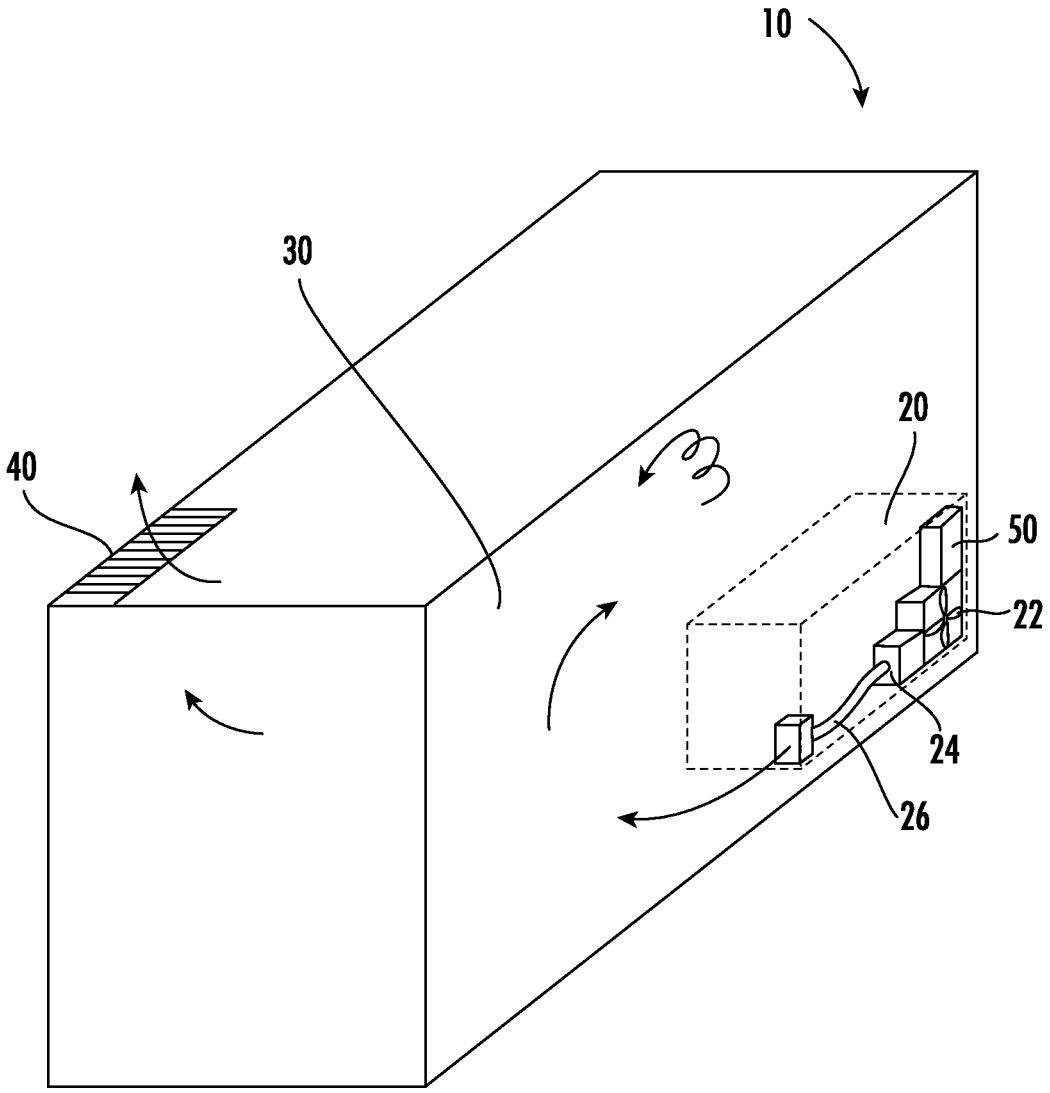
FIG. 1 schematically illustrates an exemplary refrigerated transportation container.

FIG. 1 schematically illustrates a refrigerated transportation container 10 including a refrigeration system 20. The refrigeration system 20 includes a fan 22 configured to ingest external air during standard operations. The air ingested by the fan 22 is passed over a heat exchanger 24 (such as a condenser coil). As the air passes over the heat exchanger 24, the air removes heat from the refrigerant, thereby cooling the refrigerant. The heat removed from the refrigerant is exhausted through a grille 40 to ambient, and the fan 22 ensures that air continues to circulate through across the heat exchanger 24. The exemplary refrigeration system 20 in the illustrated example is simplified, and a practical implementation can include additional elements 26 and controls according to any conventional refrigeration system. Operations of the refrigeration system 20 are controlled via a controller 50 according to any control scheme. The controller 50 in some examples includes a transmitter and receiver configured to communicate with a central controller, thereby allowing transport vessel personnel to indirectly interact with the controller 50 using a control system of the transport vessel.

During operation of the refrigeration system 20, the air ingested through the fan 22 can include contaminants. By way of example, the contaminants can include dirt, dust, grime, oil, or any similar external material capable of being entrained in the airflow. The entrained contaminants can build up on internal components of the refrigeration system 10, such as the heat exchanger 24 and negatively impacting the performance of the refrigeration system 10.

In the example of FIG. 1, the controller 50 includes a memory storing operational instructions. The operational instructions are configured to cause the controller 50 to provide predetermined response actions to conditions from the refrigeration system 20. By way of example, if the temperature within the refrigerated transport container 10 increases above a threshold, the operational instructions can cause the refrigeration system 20 to decrease the temperature of the heat exchanger 24, and the temperature of the container 10 is reduced.

One response operation that is stored within the controller 50 is a self-cleaning operation directed to cleaning/removing the buildup of contaminants from the condenser coils 24. In a general operation, when one or more sensors indicates that refrigeration operations are being negatively impacted (deteriorated) within the transportation container 10, the controller 50 is configured to compare the type deterioration to a predefined list of probable causes of the deterioration. When the probable cause of deterioration is a buildup of contaminants within the refrigeration system 20, the controller 50 is configured to respond by initiating the self-cleaning operation.

Figure 2:
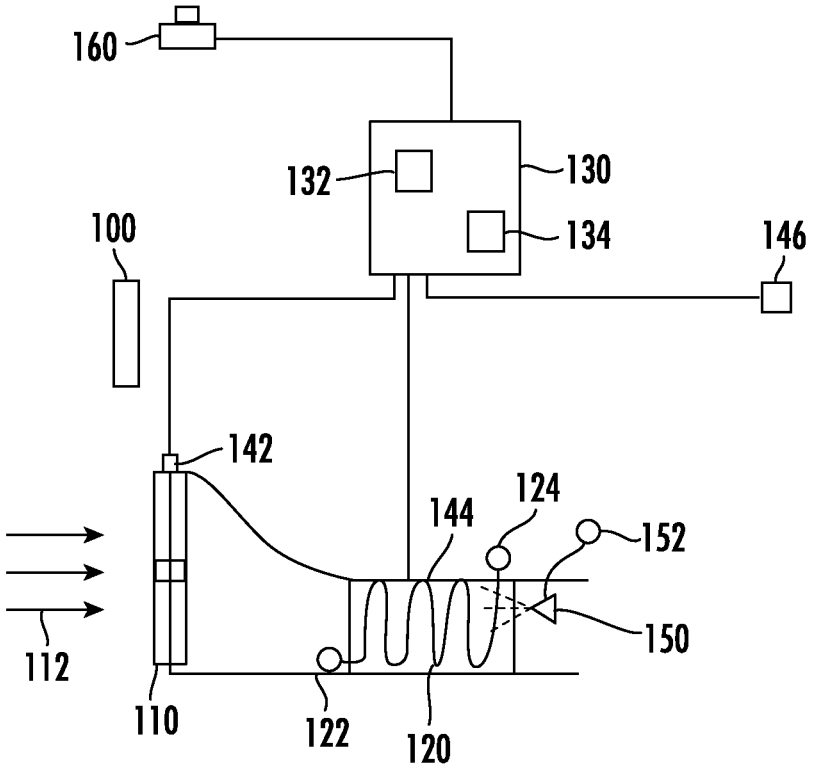
FIG. 2 schematically illustrates a refrigeration system isolated from the refrigerated transportation container, according to one example.

With continued reference to FIG. 1, FIG. 2 schematically illustrates an exemplary simplified refrigeration system 100, such as could be used in the transportation container 10 of FIG. 1. The simplified refrigeration system 100 includes a fan 110. The fan 110 ingests an airflow 112 during standard rotation, and passes the airflow 112 over a condenser coil 120. The condenser coil 120 includes an input 122 and an output 124, each of which connects to a conventional refrigerant system and provides a constant source of cooled refrigerant to the condenser coil 120. As the air passes over the condenser coil 120, the air is cooled and expelled into the storage volume 30 (illustrated in FIG. 1) of the transportation container.

A controller 130 with a processors 132 and a memory 134 is connected to the fan 110, and the refrigerant system 100. The controller 130 is configured to control both the fan 110 and the refrigerant system 100 according to any conventional control schemes. In addition, multiple sensors 142, 144, 146 are connected to the controller 130. In the illustrated example, the first sensor 142 is a fan inlet sensor 142, the second sensor 144 is a condenser coil pressure sensor 144, and the third sensor 146 is a storage volume temperature sensor 146. In addition to the sensors 142, 144, 146 a manual activation system 160 is connected to the controller and allows an operator to manually activate the self-cleaning operation. In some examples the manual activation system 160 can be a dedicated button or toggle on the container 10 itself. In alternative systems, the manual activation system 160 can be a component of an overall system controller, or other general control systems.

Included immediately downstream of the condenser coil 120 is a spray nozzle 150. The spray nozzle 150 is fluidly connected to a water source via a connection 152. The spray nozzle 150 is oriented towards the condenser coil 120, and is configured to spray water from the nozzle 150 onto the condenser coil 120 during all, or part, of the self-cleaning operation. In alternative examples, the spray nozzle 150 can be connected to another fluid, such as a solvent or cleanser, instead of or in addition to the water described above.

The fan 110 is configured such that the controller 130 can reverse the rotational direction of the fan blades during the self-cleaning operation. Reversing the direction of the fan blades reverses the direction of the airflow, and assists in the self-cleaning operation by expelling the contaminants from the condenser coil 120 area through the fan 110.

Figure 3:
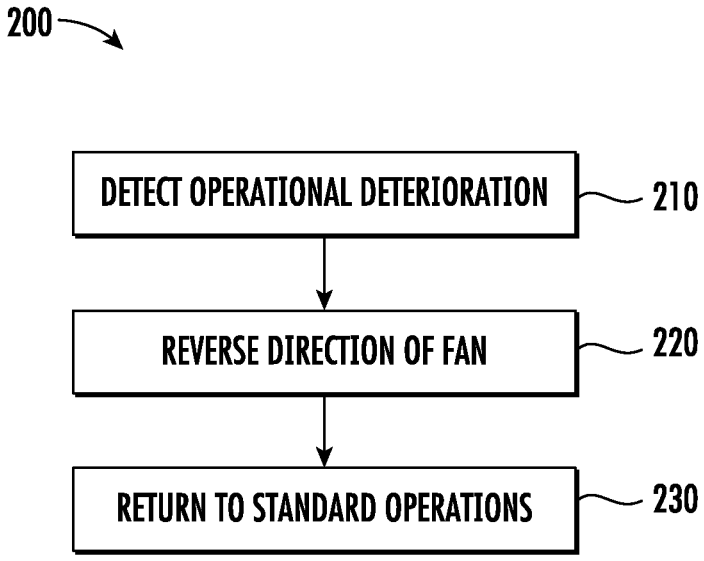
FIG. 3 schematically illustrates a method for operating the refrigeration system of FIG. 2 to automatically clean condenser coils .

With continued reference to the transportation container 10 of FIG. 1, and the refrigeration system 100 of FIG. 2, FIG. 3 illustrates a method 200 for automatically cleaning a refrigeration system. Initially, the controller 50, 130 detects an indication of a deterioration of at least one operational parameter in a "Detect Operational Deterioration" step 210. In some examples, the indication can be an increase in condenser coil pressure detected via a condenser coil pressure sensor 144. In another example, the indication can be an alarm indication from a control system. In another example the indication can be a rise in condenser motor current. In another example, the indication of deterioration can be an increase in a steady temperature of the storage volume 30 of the transportation container as detected by the storage volume 30 temperature sensor 146. In another example, the indication of operational deterioration can be a manual signal provided by an operator activating the manual activation system 160.

In yet further examples, the indication can be provided by an operator using the manual activation system 160 in response to one or more warning indicators provided through the controller 130 to a general control or alert system.

In yet further examples, the indication may be an alarm provided by the controller in response to a telematics device signaling that a self-cleaning operation is required.

In yet further examples, the indication can be any combination of the aforementioned indicators, or a combination of the aforementioned indicators with at least one additional sensed or detected factor.

Once the controller 50, 130 receives the indication of operational deterioration, the controller 50, 130, begins the self-cleaning operation by removing power from (i.e. disabling) the non-fan components of the refrigeration system and reversing the rotational direction of the fan 22, 110 in a "Reverse Direction of Fan" step 220. In a basic self-cleaning operation, the rotational direction is simply reversed, and the fan 22, 110 is operated in reverse for a predetermined period of time. In such an example, reversal of the direction of airflow through the refrigeration system will dislodge loose or light dust and other contaminants and drive the contaminants out of the refrigeration system through the fan 22, 110.

In another example, such as one where heavy, or sticky, contaminants are expected to be present, the fan 22, 110 can be operated in a pulsing manner by rapidly increasing and decreasing the rotational speed while the fan 22, 110 is rotating in the reverse direction. The rapid increases and decreases in speed create air pulses that further help dislodge contaminants from the refrigerator coil, or other portions of the refrigeration system. In yet another example, the speed of the fan 22, 110 can be suddenly increased a single time to create an initial pulse disturbing the contaminants. After the initial burst the speed of the fan can either be reverted to the standard operational speed, or maintained at the increased levels.

In another example, the spray nozzle 150 is activated either simultaneously with, or shortly after, reversing the rotational direction of the fan 22, 110. The activation of the spray nozzle sprays water, a cleaner/solvent, or a mixture of the two onto the refrigeration coil while the fan 22, 110 is rotating in the reverse direction. The fluid from the spray nozzle dislodges contaminants and the reversed airflow removes the contaminants and the fluid from the refrigeration system.

While described as distinct examples above, it is understood that any given self-cleaning operation can include some or all of the steady airflow, pulsed airflow, and spray nozzle. And each of the steady airflow, pulsed airflow, and spray nozzle operations can be operated for only a part or for all of the self-cleaning operation.

Once a predetermined duration for the self-cleaning operation has elapsed, the controller 22, 130 reverts the rotational direction of the fan 22, 130 to the standard rotational direction in a "Return to Standard Operations" step 230.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A method for cleaning a refrigeration coil of a refrigerated transportation container comprising:

detecting an indication of operational deterioration of a transportation container refrigeration system using one or more sensors to detect that refrigeration operations are deteriorating within the refrigerated transportation container and communicating associated deterioration information to a controller;

in accordance with a determination of a buildup of contaminants within the transportation container refrigeration system based on the associated deterioration information, the controller responds by removing power from non-fan components of the transportation container refrigeration system and implementing a cleaning operation comprising:

reversing a rotational direction of an airflow fan from a first direction to a second direction such that air is drawn over the refrigeration coil and expelled from the refrigerated transportation container using the airflow fan; and reverting the rotational direction of the airflow fan to the first direction at a conclusion of the cleaning operation.

2. The method of claim 1, wherein the indication of operational deterioration is a refrigeration system pressure drop detected by the one or more sensors.

3. The method of claim 1, wherein the indication of operational deterioration is an increase in temperature of the refrigerated transportation container detected by the one or more sensors.

4. The method of claim 1, wherein the indication of operational deterioration is a manually applied trigger.

5. The method of claim 1, wherein reversing the rotational direction of the airflow fan further comprises increasing a speed of the airflow fan, thereby creating a burst of airflow.

6. The method of claim 5, wherein increasing the speed comprises maintaining an increased speed until the step of reverting the rotational direction of the airflow fan.

7. The method of claim 5, wherein increasing the speed comprises iteratively increasing and decreasing the speed of the airflow fan, thereby pulsing an airflow through the airflow fan.

8. The method of claim 1, wherein the controller is configured to compare deterioration to a predefined list of probable causes of the deterioration, and in accordance with a determination that the probable cause of deterioration is the buildup of contaminants, the controller initiates the cleaning operation and the conclusion of the cleaning operation is defined by a predetermined duration.

9. The method of claim 1, wherein reversing the rotational direction of the airflow fan further comprises activating a spray nozzle, and spraying a liquid onto the refrigeration coil.

10. The method of claim 1, wherein the indication of operational deterioration is a self-cleaning operation signal from a telematics device.

11. A transportation container comprising:

a storage volume;

a refrigeration system in communication with the storage volume, the refrigeration system including an airflow fan configured to ingest exterior air, a condenser coil immediately downstream of the airflow fan, and a vent configured to exhaust spent cooling air from the storage volume;

one or more sensors to detect that refrigeration operations are deteriorating within the transportation container and communicating associated deterioration information to a controller; and the controller configured to control the refrigeration system, the controller including instructions configured to receive associated deterioration information from the one or more sensors, and in accordance with a determination of a buildup of contaminants within the refrigeration system based on the associated deterioration information, the controller responds to remove power from non-fan components of the refrigeration system and reverse a rotational direction of the airflow fan from a first direction to a second direction such that air is drawn over the condenser coil and expelled from the transportation container using the airflow fan, and revert the rotational direction of the airflow fan to the first direction at a conclusion of a cleaning operation.

12. The transportation container of claim 11, further comprising at least one fluid spray nozzle disposed downstream of the condenser coil, relative to a direction of airflow during cooling operations.

13. The transportation container of claim 12, wherein the at least one fluid spray nozzle is connected to at least one of a water source and a cleaner source.

14. The transportation container of claim 11, wherein the one or more sensors comprise at least one of a condenser coil pressure sensor disposed at the condenser coil and a container temperature sensor that is used to detect an indication of operational deterioration of the refrigeration system, and wherein the controller is configured to compare deterioration to a predefined list of probable causes of the deterioration, and in accordance with a determination that the probable cause of deterioration is the buildup of contaminants, the controller initiates the cleaning operation.

15. The transportation container of claim 11, wherein reversing the rotational direction of the airflow fan further comprises increasing a speed of the airflow fan, thereby creating a burst of airflow.

16. The transportation container of claim 15, wherein increasing the speed comprises maintaining an increased speed until the step of reverting the rotational direction of the airflow fan.

17. The transportation container of claim 15, wherein increasing the speed comprises iteratively increasing and decreasing the speed of the airflow fan, thereby pulsing an airflow through the airflow fan.

18. The transportation container of claim 11, wherein the controller is configured to be connected to at least one self-cleaning operation of a manual activation system.

19. The transportation container of claim 18, wherein the controller is directly connected to the manual activation system.

20. The transportation container of claim 18, wherein the controller is connected to the manual activation system through at least one intermediary controller.

21. The transportation container of claim 12, wherein during the cleaning operation, contaminants from the condenser coil are expelled out through the airflow fan when the at least one fluid spray nozzle is actively spraying and the airflow fan is rotating in the second direction.

22. The transportation container of claim 11, wherein:

the airflow fan is at an air inlet to the storage volume and is configured to ingest the exterior air and then pass ingested air over the condenser coil during standard operation when the airflow fan is rotating in the first direction; and when the airflow fan is rotating in the second direction during the cleaning operation, contaminants are expelled from the condenser coil through the airflow fan and out of the transportation container.

23. The transportation container of claim 22, including at least one spray nozzle downstream of the condenser coil and, during the cleaning operation, contaminants are expelled from the condenser coil out of the transportation container through the airflow fan when the at least one spray nozzle is actively spraying and the airflow fan is rotating in the second direction.

24. The method of claim 1, including:

positioning the airflow fan at an air inlet to the refrigerated transportation container such that the airflow fan is upstream of the refrigeration coil;

ingesting air via the airflow fan, with ingested air subsequently being passed over the refrigeration coil during standard operation when the airflow fan is rotating in the first direction; and when the airflow fan is rotating in the second direction during the cleaning operation, further including expelling contaminants from the refrigeration coil through the airflow fan and out of the refrigerated transportation container.

25. The method of claim 24, including:

positioning the refrigeration coil immediately downstream of the airflow fan;

positioning at least one spray nozzle downstream of the refrigeration coil; and during the cleaning operation, the method further includes expelling contaminants from the refrigeration coil out of the refrigerated transportation container through the airflow fan when the at least one spray nozzle is actively spraying and the airflow fan is rotating in the second direction.

* * * * *